US008603417B2

(12) United States Patent
Cefaratti

(10) Patent No.: US 8,603,417 B2
(45) Date of Patent: Dec. 10, 2013

(54) COMBINATION TUBE AND CAP FOR STORAGE AND TRANSPORT OF FLUID SAMPLES

(76) Inventor: Michael J. Cefaratti, Willoughby, OH (US)

( * ) Notice: Subject to any disclaimer, the term of this patent is extended or adjusted under 35 U.S.C. 154(b) by 785 days.

(21) Appl. No.: 12/546,239

(22) Filed: Aug. 24, 2009

(65) Prior Publication Data

US 2011/0044867 A1 Feb. 24, 2011

(51) Int. Cl.
*B01L 3/14* (2006.01)

(52) U.S. Cl.
USPC ..... 422/550

(58) Field of Classification Search
USPC ..... 422/550
See application file for complete search history.

(56) References Cited

U.S. PATENT DOCUMENTS 3,881,627 A * 5/1975 Davolt ..... 215/329
4,390,111 A * 6/1983 Robbins et al. ..... 220/259.1
5,384,096 A * 1/1995 Burns ..... 422/549
5,855,289 A * 1/1999 Moore ..... 215/270
5,948,365 A * 9/1999 Macy et al. ..... 422/550
6,277,331 B1 * 8/2001 Konrad ..... 422/547
6,562,300 B2 * 5/2003 Rosen et al. ..... 422/550

* cited by examiner

*Primary Examiner* — Bobby Ramdhanie
*Assistant Examiner* — Bryan Kilpatrick
(74) *Attorney, Agent, or Firm* — Renner Kenner Greive Bobak Taylor & Weber

(57) ABSTRACT

Tube and cap assemblies for retaining an aliquot of fluid suitably for transferring such samples within a laboratory or between laboratories include a tube portion having at least one sidewall defining an open top. A flange extends outwardly from the open top and includes a top surface and a bottom surface. At least one channel is provided in the top surface of the flange, and an internal closed bottom extends from the at least one sidewall. The cap includes at least one peripheral wall, a hub inset from the at least one peripheral wall, and a plurality of ribs extending from the hub to the at least one peripheral wall to strengthen it against forces inward toward the hub. The cap further includes a neck having at least one bubble ring, a rim extending from the neck, and at least one sealing rib extending from the rim. In the assembly, where the cap is secured to the transfer tube, the neck extends into the open top of the transfer tube and the at least one bubble ring sealingly contacts the at least one sidewall, and the at least one sealing rib extends into the at least one channel.

9 Claims, 8 Drawing Sheets

COMBINATION TUBE AND CAP FOR STORAGE AND TRANSPORT OF FLUID SAMPLES

FIELD OF THE INVENTION

The present invention generally relates to tubes with associated caps for retaining fluid samples. More particularly, the present invention relates to such tubes and caps having improved sealing structures. In particular embodiments, the present invention relates to tubes and caps for storing and transporting an aliquot of plasma or serum from blood samples.

BACKGROUND OF THE INVENTION

It will be appreciate by those having general knowledge in the relevant fields that there is currently no good storage and transfer device for storing and transporting aliquots of fluid samples in hospitals and medical research labs. Although aliquot tubes and caps exist, they are typically designed for storage in one location associated with the laboratory equipment that will be used to analyze the aliquot. In particular, some laboratory equipment, such as the well-known Beckman Coulter Power Processor Automated Sample Processing System, is designed to store the aliquot tubes and to retrieve them from storage to advance them through the processing system for analysis. The tubes and caps are therefore designed sufficiently for the processing system, for example, having caps that are readily removed by the cap removal apparatus of the processing system, but are not designed suitable for transport to other laboratories, whether located within the same facility, requiring transport by person, or located at another facility, requiring transport by car, ambulance, plane, helicopter or the like.

Of course, these tubes and caps are sometimes transported, but they are known to suffer from a number of drawbacks. For example, a specific example of a prior art tube and cap is the Beckman Coulter Aliquot Tube and Cap assembly. This tube and cap combination is known to provide a weak seal between the cap and tube such that the cap can leak and even fall off if care is not taken to prevent this during transport. Additionally, the cap was never designed for courier transport. The art would therefore benefit from tube and cap combinations that provide a substantial seal between the tube and the cap so that the cap stays on absent a purposeful removal thereof and prohibits leaking when on the tube. The art would also benefit from a stronger cap not easily susceptible to distortion when gripped tightly by an individual or machine.

It should also be appreciated that any type of air transport or even ground transport to higher or lower elevations will entail a significant pressure change, and any tube and cap combination intended for such transport must be able to withstand pressure changes. Some tube and cap combinations have caps that engage tubes by means of threading (i.e. screw caps), and some of these screw cap embodiments have been found to provide suitable sealing against pressure changes. However, these screw cap embodiments are less suitable for sample processing systems in the art, which, as is known, do not provide mechanisms for replacing threaded caps onto threaded tubes, though some do provide mechanisms for removing threaded caps from threaded tubes. Push caps, that is caps removed and replaced simply by pulling the cap from and pushing the cap into the open end of the tube, are therefore preferred for use in such systems, and are further preferred because they are easier for an individual to open and close. It is believed that there currently exists no aliquot tube and push cap combination suitable for transport through such changes in pressure, and the art would therefore benefit from a tube and cap combination providing a seal that can withstand significant pressure changes.

SUMMARY OF THE INVENTION

This invention provides a tube and cap for retaining an aliquot of fluid suitably for transferring such samples within a laboratory or between laboratories. The transfer tube includes a tube portion having at least one sidewall defining an open top. A flange extends outwardly from the open top and includes a top surface and a bottom surface. At least one channel is provided in the top surface of the flange, and an internal closed bottom extends from the at least one sidewall. The cap includes at least one peripheral wall, a hub inset from the at least one peripheral wall, and a plurality of ribs extending from the hub to the at least one peripheral wall to strengthen it against forces inward toward the hub. The cap further includes a neck having at least one bubble ring, a rim extending from the neck, and at least one sealing rib extending from the rim. When the cap is secured to the transfer tube, the neck extends into the open top of the transfer tube and the at least one bubble ring sealingly contacts the at least one sidewall, and the at least one sealing rib extends into the at least one channel.

DETAILED DESCRIPTION OF ILLUSTRATIVE EMBODIMENTS

Figure 1:
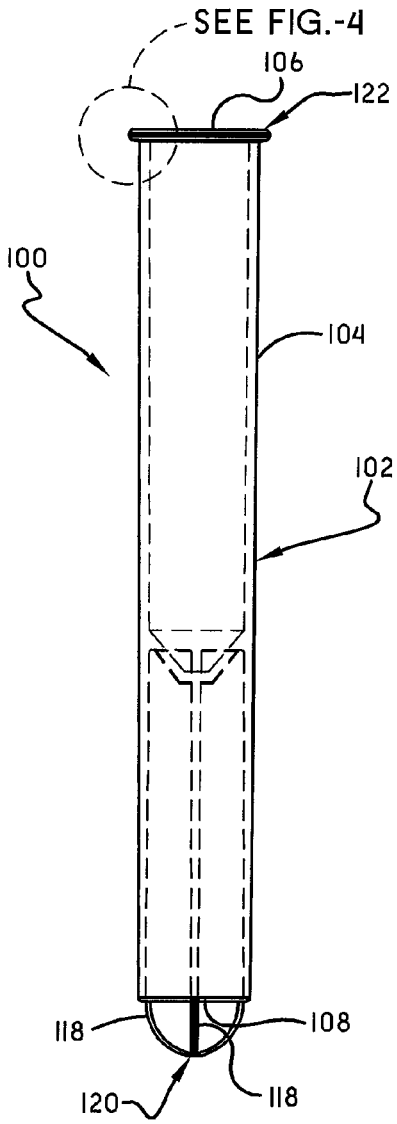
FIG. 1 is a side elevation view of a transfer tube in accordance with this invention.
Figure 2:
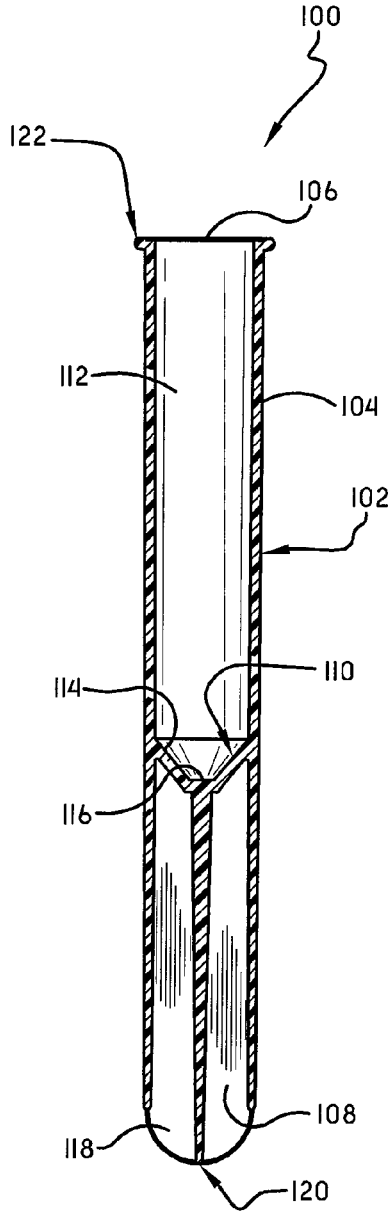
FIG. 2 is a cross-sectional view of the transfer tube of FIG. 1.

This disclosure provides information respecting transfer tube and cap combinations. Particularly, a transfer tube is shown in the drawings and discussed herein, and two different caps are provided, one intended for simple transport and storage, and the other particularly intended for transport and suitable for transport where there might be a significant change in pressure experienced by the transfer tube and cap. Thus, the transfer tube is first shown and disclosed, and the two caps and their interaction with the transfer tube are shown and disclosed thereafter.

Referring now to FIGS. 1-4, a transfer tube in accordance with this invention is shown and designated by the numeral 100. The transfer tube 100 includes a tube portion 102 that is formed of at least one side wall 104 defining an open top 106 of the transfer tube 100 and extending to an open bottom 108. An internal closed bottom 110 extends from the at least one side wall 104 to define a storage volume 112 between the open top 106, the at least one side wall 104 and the internal closed bottom 110. The internal closed bottom 110 is frustoconical, having a conical side wall 114 extending to a flat bottom 116. This shape serves to facilitate the removal of fluid from the transfer tube 100 by use of a pipette or similar device. Reinforcement tube ribs 118 extend from the internal closed bottom 110 toward and beyond the open bottom 108 of the at least side wall 104, and reinforce the at least one side wall 104 for increased structural integrity. The tube ribs 118 are rounded at their distal ends to provide a rounded transfer tube bottom 120. This rounded transfer tube bottom 120 gives the transfer tube 100 the general external shape of a test tube, which is the shape that is generally preferred, particularly in medical applications employing aliquot sample tubes. As seen in the bottom view of FIG. 3A, four tube ribs 118 are employed, joining their neighboring tube ribs at right angles. This could also be conceptualized as having two tube ribs that intersect each other to provide a cross-shaped or plus sign cross-section.

Figure 3A:
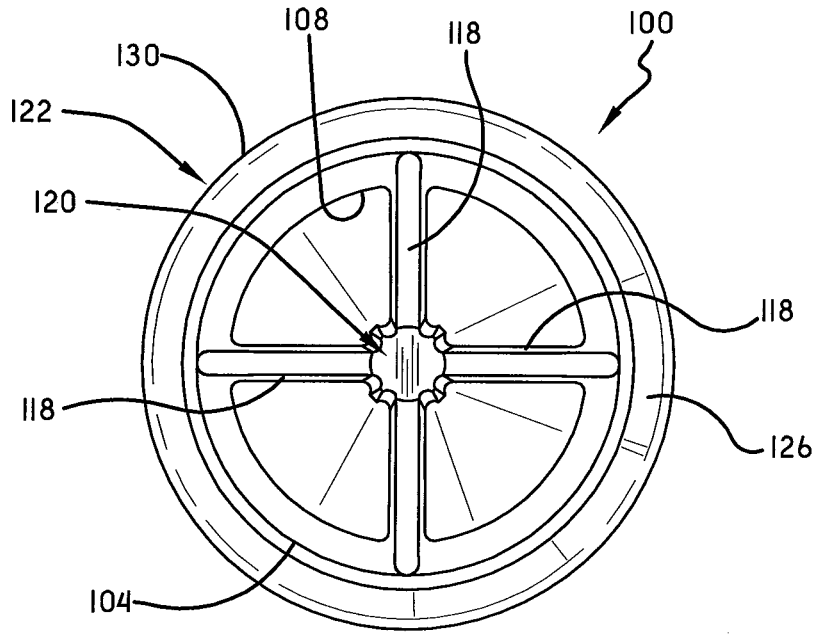
FIG. 3A is a bottom plan view of the transfer tube of FIG. 1.
Figure 3B:
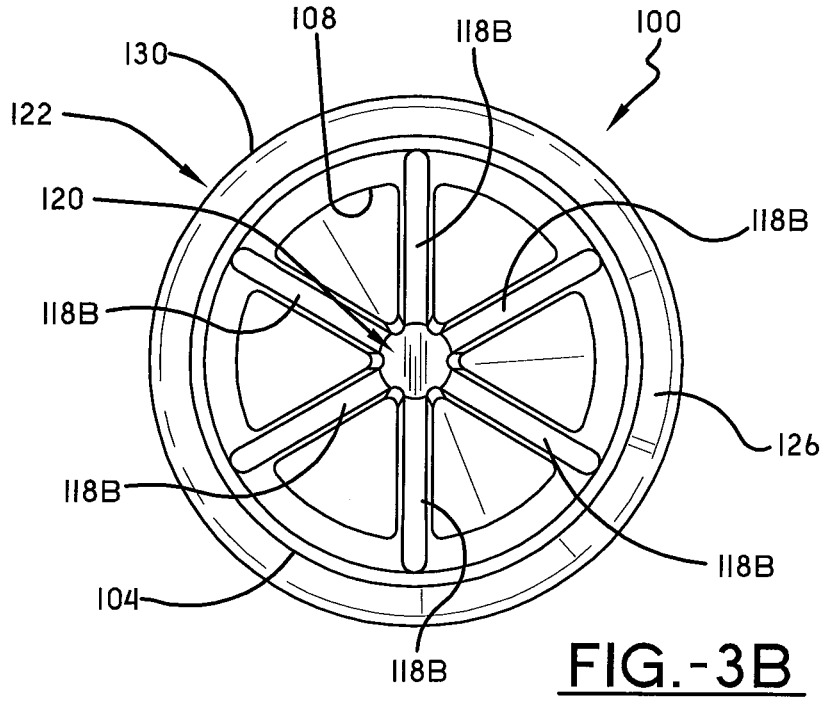
FIG. 3B is a bottom plan view of an alterative embodiment of the transfer tube of FIG. 1.

As seen in and alternative embodiment in FIG. 3B, six tube ribs 118B might be employed, with each tube rib being spaced from its neighboring tube ribs by 60 degrees. This could also be conceptualized as having three tube ribs intersecting each other. More or less tube ribs could be employed, and they need not be equally spaced from each other as in the embodiments shown. In particular embodiments, these tube ribs 118 provide suitable structural integrity to permit these tubes 100 to be gripped and moved and manipulated by automated sample processing systems, such as, for example, the Beckman Coulter Power Processor Automated Sample Processing System. It has been found that the six tube rib embodiment centers itself better in tube carrier trays in the automated sample processing systems.

The description "at least one side wall 104" has been employed to disclose the side wall structure of the transfer tube 100 because, although the transfer tube of this particular embodiment is circular in cross-section, having only one side wall, it should be appreciated that other shapes could be provided, requiring what might conceptually be multiple side walls joined together. For example, a transfer tube that was of square cross-section might be considered to have four side walls. This invention is not to be limited to or by any particular shape for the axial length of the transfer tube 100, so the term "at least one side wall" has been employed to make this clear.

In a particular embodiment, the internal diameter of the transfer tube 100 is 10.5 mm, the outside diameter at flange 122 is 15 mm, the tube 100 has an internal dimension from open top 106 to flat bottom 116 of approximately 58.4 mm, the length of the transfer tube 100 from open top 106 to transfer tube bottom 120 is approximately 100 mm, the at least one sidewall 104 is 1.5 mm thick, the flange 122 is 1.3 mm in height from top surface 124 to where the flange 122 meets the sidewall 104 at bottom surface 126, the taper to bottom surface 126 is at 105 degrees relative to the sidewall 104, the flange 122 sticks out 3 mm beyond the sidewall 104, and the frustoconical surface 128 at 55 degrees relative to the top surface 124. In another particular embodiment, the dimensions are the same, but for the transfer tube 100 having a length of 75 mm from open top 106 to transfer tube bottom 120.

Figure 4:
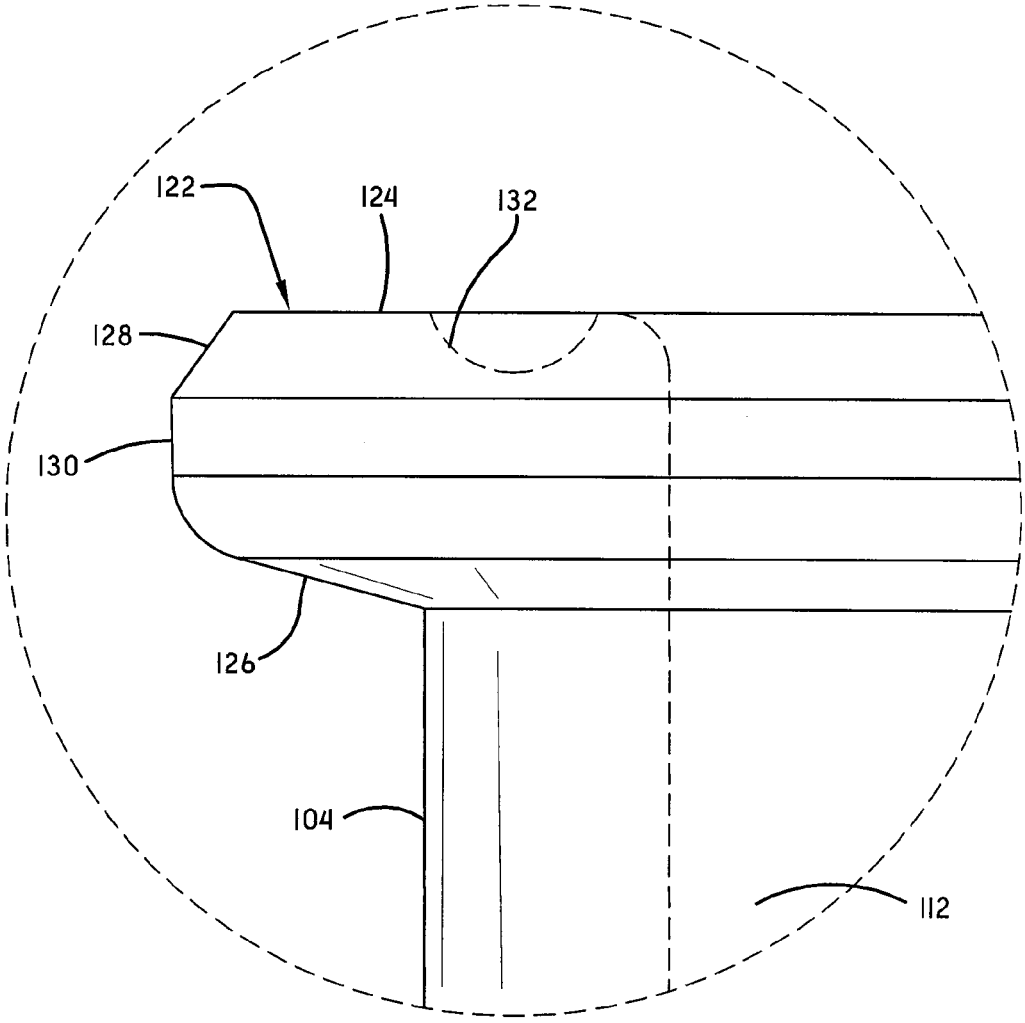
FIG. 4 is an exploded view of the detail labeled by the numeral 4 in FIG. 1.
Figure 5:
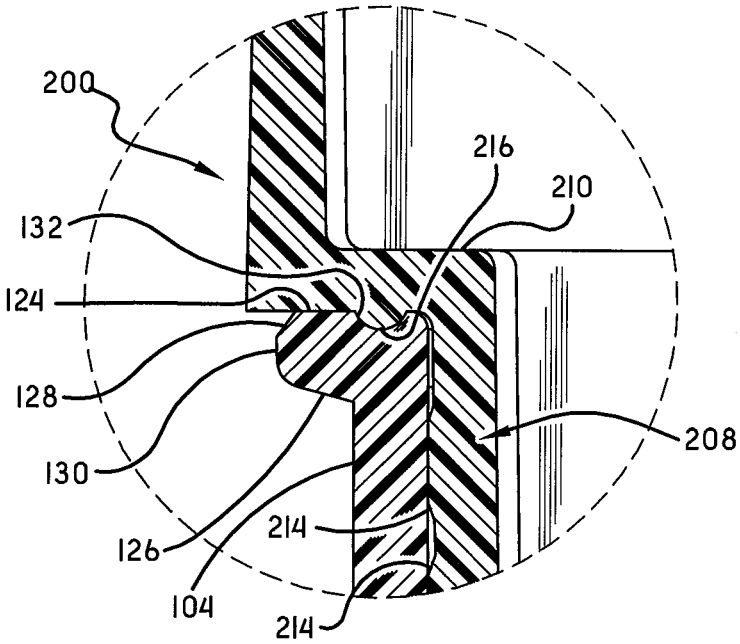
FIG. 5 is an exploded cross-sectional view showing the interaction of the storage cap of FIG. 7 with the transfer tube of FIG. 1.
Figure 6:
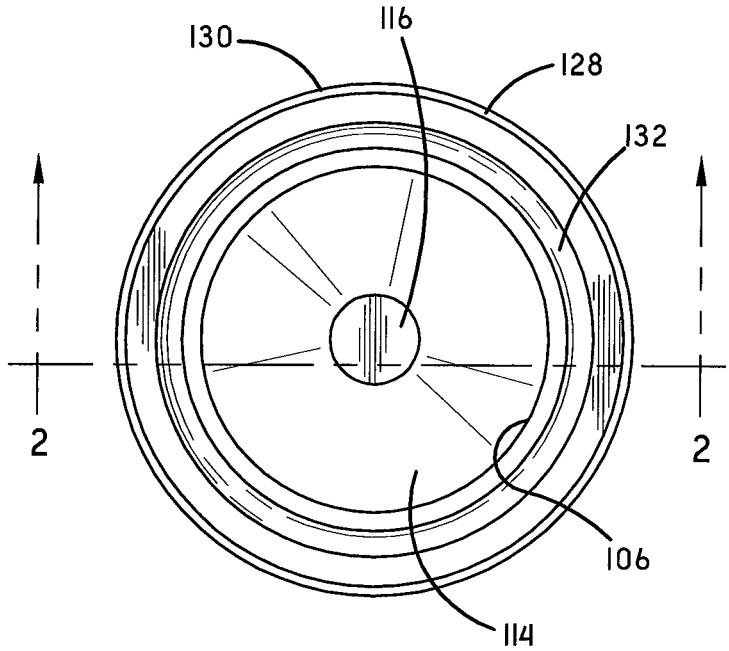
FIG. 6 is a top plan view of the transfer tube of FIG. 1.

A flange 122 extends radially from the open top 106. This flange 122 provides not only a contact surface for the caps that will be disclosed herein, but also provides specific structures to improve the sealing between those caps and the transfer tube 100. It also provides structures to assist in the removal of the caps from the transfer tube 100. Particularly, as seen in the exploded cross-sectional view of FIG. 4, the flange 122 includes a top surface 124 and a bottom surface 126, with the top surface 124 tapering toward the bottom surface at frustoconical surface 128. As seen in FIG. 5, where a storage cap 200 has been secured to the transfer tube 100, this taper at frustoconical surface 128 serves to provide an axial gap between the storage cap 200 and the transfer tube 100 to assist in the removal of the cap 200 from transfer tube 100. In this embodiment, the bottom surface 126 is itself tapered along its entire length, and both the frustoconical surface 128 and the top surface 124 and the tapered bottom surface 126 meet at a peripheral edge 130. With particular reference to FIGS. 4 and 6, it can be seen that the top surface 124 of the flange 122 includes at least one channel 132. In this particular embodiment, the channel is shown as being continuous, extending around the entire open top 106. In accordance with other embodiments, this channel 132 could be made to be discontinuous, though the continuous structure is preferred.

The transfer tube 100 is preferably of an integral structure (i.e., one piece), which structure could be accomplished by forming the tube through injection molding. Currently, the at least one embodiment of the Beckman Coulter aliquot tube is a two-piece tube, with a tube extension snapping together with the remainder proximate the closed bottom of the interior. This two-piece design requires additional labor to assembly. In this invention, the transfer tube 100 is preferably made of plastic, and, for medical applications, preferably from medical grade polypropylene.

Figure 7:
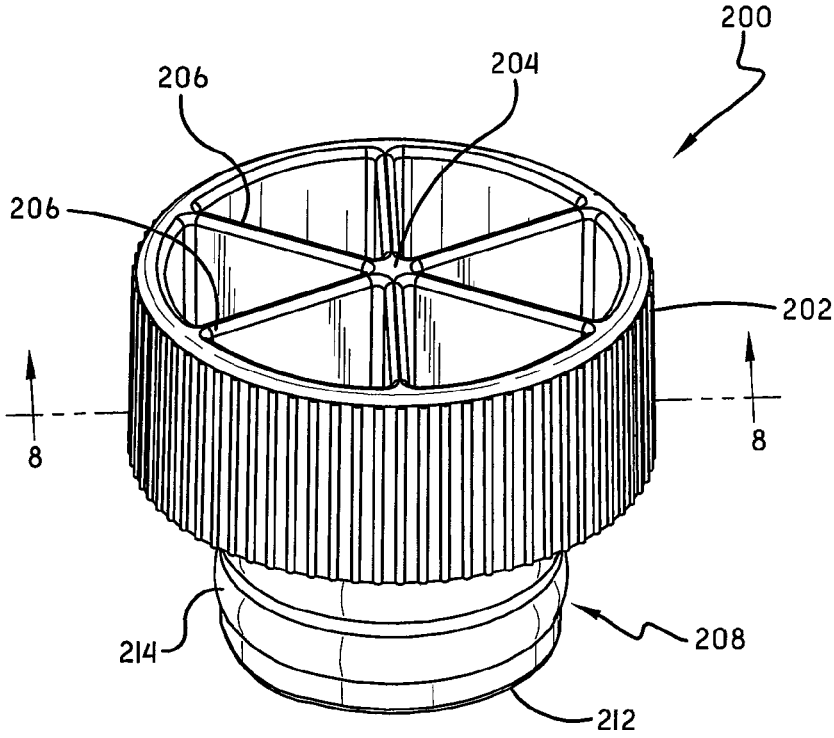
FIG. 7 is a perspective view of a storage cap in accordance with this invention.
Figure 8:
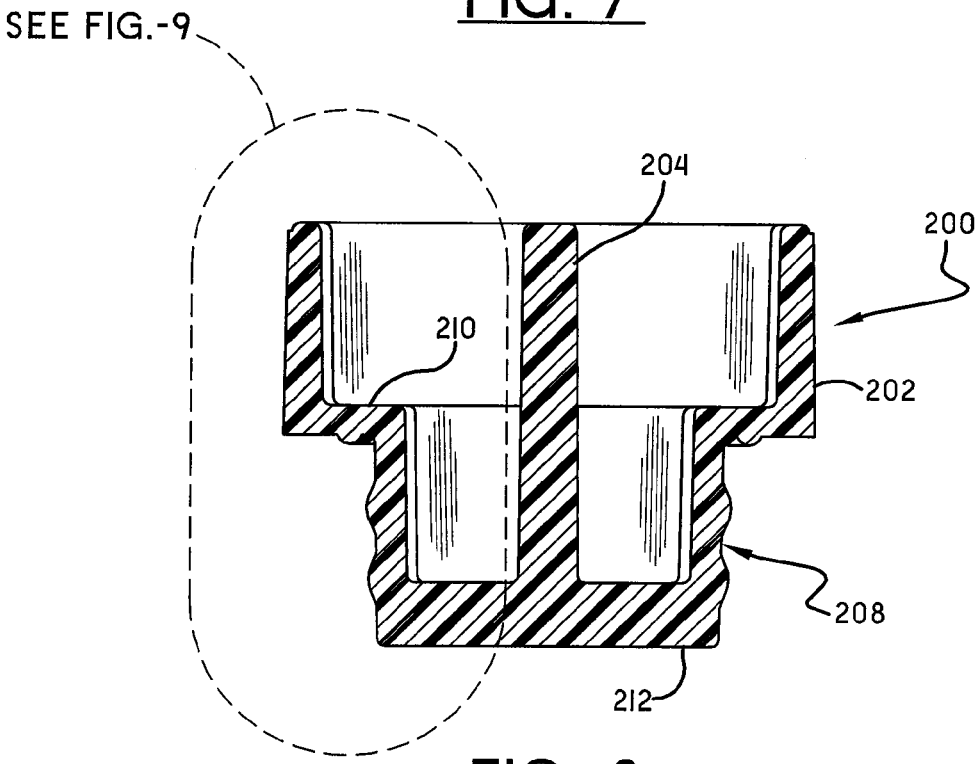
FIG. 8 is a cross-sectional view of the storage cap of FIG. 7.
Figure 9:
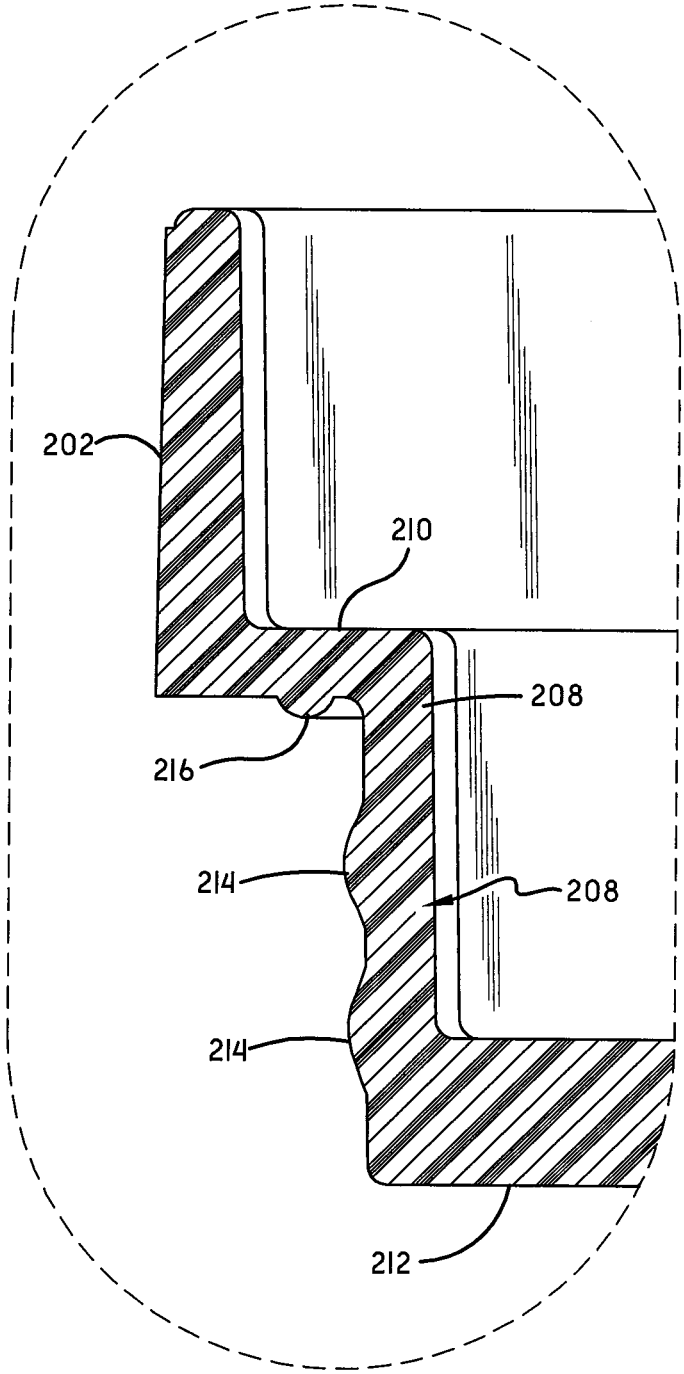
FIG. 9 is an exploded view of the detail identified in FIG. 8 by the numeral 9.
Figure 10:
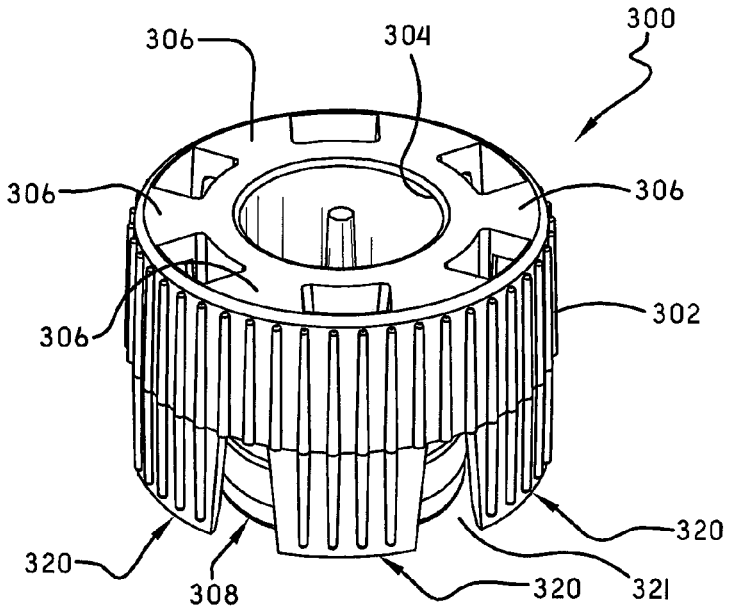
FIG. 10 is a perspective view of a transport cap in accordance with this invention.

A storage cap in accordance with this invention is shown in FIGS. 7-9 and designated by the numeral 200. Storage cap 200 includes at least one peripheral wall 202, which may be ridged as shown in FIG. 7 to provide a good grip surface for an individual manually removing the cap 200 from a tube to which it is secured. A hub 204 is inset from the at least one peripheral wall 202, and a plurality of ribs 206 extend from the hub 204 to strengthen the at least one peripheral wall 202 against forces pressing inward toward the hub 204. Six ribs are shown in this embodiment, but more or less can be practiced. In particular embodiments, these ribs 206 provide suitable structural integrity to permit these caps 200 to be gripped and moved and manipulated by automated sample processing systems, such as, for example, the Beckman Coulter Power Processor Automated Sample Processing System, and, in particular, the cap-removing features (decappers) thereof.

The cap 200 further includes a neck 208 that is joined to the at least one peripheral wall 202 by a rim 210. As seen in FIG. 8, the neck 208 and the at least one peripheral wall 202 preferably form a hollow construct such that the hub 204 and the ribs 206 extending therefrom extend into the neck to strengthen the neck 208 as well as the at least one peripheral wall 202. As seen in FIG. 8, the storage cap 200 is preferably of an integral structure, which structure could be accomplished by forming the storage cap 200 through injection molding. The storage cap 200 is preferably made of plastic, and, for medical applications, preferably from medical grade polypropylene. The neck 208 includes two bubble rings 214 in this embodiment, though it should be appreciated that a single bubble ring 214 is also suitable. As will be seen, the bubble rings 214 serve to engage the interior surface of the side wall 104 of the transfer tube 100 to seal the interior volume of the transfer tube 100. As best seen in the exploded view of FIG. 9, at least one sealing rib 216 extends downwardly from the rim 210. The storage cap 200 includes a bottom wall 212, in this embodiment shown at the bottom of the neck 208, though it should be appreciated that it could be otherwise positioned suitably to serve as a seal for the open top 106 of a transfer tube 100, when the storage cap 200 is secured thereto.

Referring now to FIG. 5, the storage cap 200 fits into and over the open end 106 of the transfer tube 100 to seal the same. Particularly, the neck 208 extends into the interior volume 112 of the transfer tube 100, and the bubble rings 214 intimately contact the interior surface of the side wall 104 to seal against the transmission of fluid past these bubble rings 214. To further seal the transfer tube 100, the at least one sealing rib 216 is positioned so as to intimately fit into the at least one channel 132 provided in the top surface 124 of the flange 122. The outside diameter of the at least one peripheral wall 202 is such that the rim 210 radially extends slightly beyond the peripheral surface 130 of the flange 122, and an axial gap is formed between the bottom surface of wall 210 of the cap 200 and the frustoconical surface 128. This axial gap and the extension of the rim 210 can facilitate the removal of the cap 200 by providing some needed space. This invention could also be practiced without a frustoconical surface 128. This invention could also be practiced with peripheral wall 202 being aligned with peripheral surface 130.

A transport cap in accordance with this invention is shown in FIGS. 10-13 and designated by the numeral 300. Transport cap 300 includes at least one peripheral wall 302. A hub 304 is inset from the at least one peripheral wall 302, and a plurality ribs 306 extend from the hub 304 to strengthen the at least one peripheral wall 302 against forces pressing inward toward the hub 304. Six ribs are shown in this embodiment, but more or less can be practiced. In particular embodiments, these ribs 306 provide suitable structural integrity to permit these caps 300 to be gripped and moved and manipulated by automated sample processing systems, such as, for example, the Beckman Coulter Power Processor Automated Sample Processing System, and, in particular, the cap-removing features (decappers) thereof.

Figure 11:
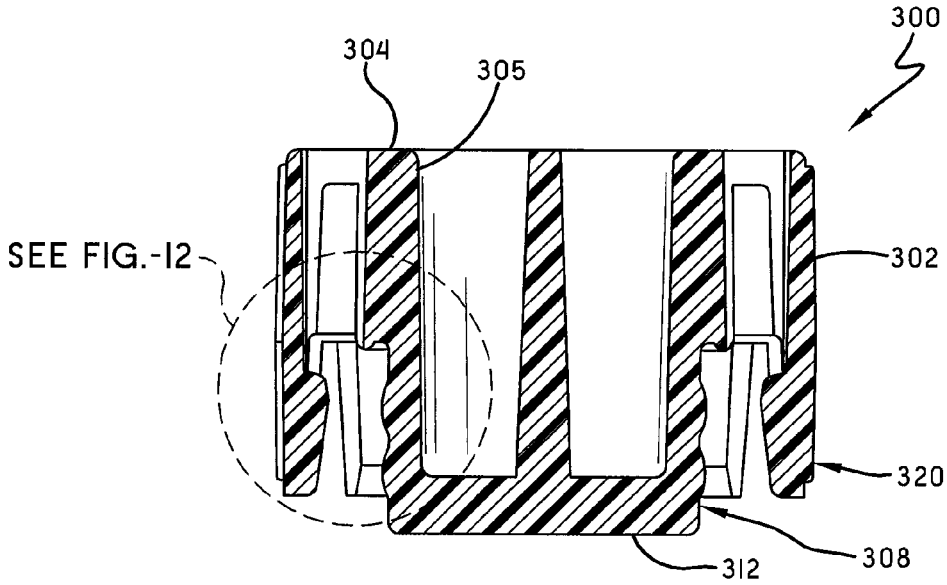
FIG. 11 is a cross-sectional view of the transport cap of FIG. 8.
Figure 12:
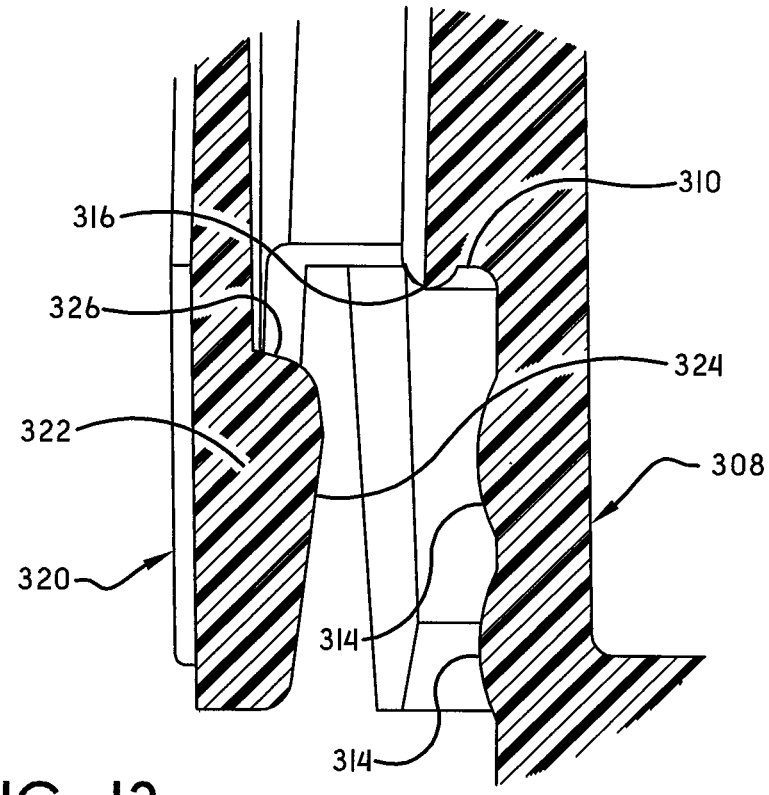
FIG. 12 is an exploded cross-sectional view of the detail identified by the numeral 12 in FIG. 9.

As seen in FIG. 11, the hub 304 is formed by an inner wall 305 that extends to provide a neck 308. The transport cap 300 is preferably of an integral structure as similarly disclosed with respect to the storage cap 200 and the transfer tube 100. The neck 308 includes two bubble rings 314 (FIG. 12) in this embodiment, though it should be appreciated that a single bubble ring 314 might also be suitable. As already disclosed with respect to the storage cap 200, the bubble rings 314 serve to engage the interior surface of the side wall 104 of the transfer tube 100 to seal the interior volume thereof. As best seen in FIGS. 12, the interior wall 305 is thicker above the neck 308 such that a small rim 310 is provided. At least one sealing rib 316 extends downwardly from this rim 310. The transport cap 300 includes a bottom wall 312, in this embodiment shown at the bottom of the neck 308, though it should be appreciated that that it could be otherwise positioned suitably to serve as a seal for the open top 106 of a transfer tube 100, when the transport 300 is secured thereto. The transport 300 further includes at least one locking tab 320 extending downwardly from the peripheral wall 302. More particularly, and as already mentioned, the at least one locking tab 320 is preferably integral with the remainder of the transport cap 300, and, thus, the at least one locking tab 320 is simply an extension from the at least peripheral wall 302, as seen in the drawings. Although the at least one locking tab 320 could be formed of a continuous extension of the at least one peripheral wall 302, in the embodiment shown and preferred, a plurality of locking tabs are provided, thus defining gaps 321 therebetween. In this embodiment, six locking tabs are provided, with the center of each locking tab 320 being offset by 60° from the center of the neighboring locking tabs. Each of the locking tabs 320 each include a beveled head 322 providing a ramp surface 324 and a stop surface 326.

Figure 13:
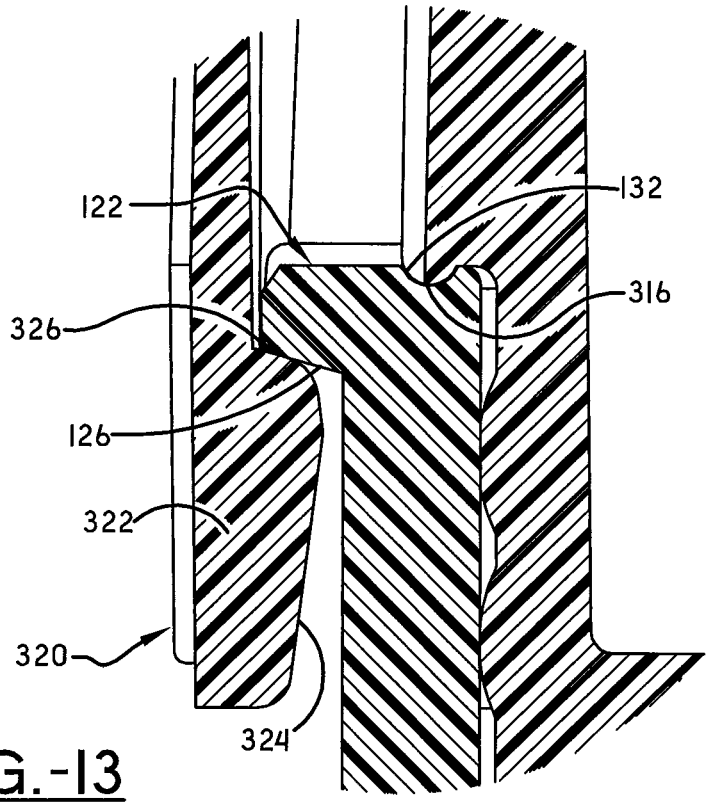
FIG. 13 is an exploded cross-sectional view showing the interaction of the cap of FIG. 8 with the transfer tube of FIG. 1.

Referring now to FIG. 13, the transport cap 300 fits into and over the open end 106 of the transfer tube 100 to seal the same. Particularly, the neck 308 extends into the interior volume 112 of the transfer tube 100, and the bubble rings 314 intimately contact the interior surface of the side wall 104 to seal against the transmission of fluid past these bubble rings 314. To further seal the transfer tube 100, the at least one sealing rib 316 is positioned so as to intimately fit into the at least one channel 132 provided in the top surface 124 of the flange 122. In this embodiment, the at least one peripheral wall 302, and locking tabs 320 extending therefrom, extend radially beyond the radial edge 130 of the flange 122 such that, as the transport cap 300 is secured to the transfer tube 100, the beveled head 322 ramps over the flange 122 as a result of contact between the ramp surface 324 and the flange 122. The transport cap 300 is sized such that, when it is fully secured to the transfer tube 100, with the at least one sealing rib 316 extending into the at least one channel 132, the stop surface 326 of the beveled head 322 is positioned under and is radially aligned with the bottom surface 126 of the flange 122, such that the removal of the transport cap 300 is frustrated by contact between those surfaces. It is also preferably sized so that when the cap 300 is properly secured to the tube 100, the stop surface 326 intimately contacts the bottom surface 126 of the flange 122 so that there is no potential for axial movement either up or down so long as the stop surface 326 and the bottom surface 126 remain aligned. This will keep the sealing rib 316 in the channel 132, further isolating and protecting the contents of the tube 100.

The transport cap 300, as its name implies, is intended for use in transporting fluid samples, and it is therefore important that the seal created between the transport cap 300 and the transfer tube 100 be able to withstand pressure changes so as to be particularly suitable for transportation by aircraft. In the United States, the Department of Transportation (DOT) sets standards for the air transport of packages containing hazardous material, currently codified in 49 Code of Federal Regulations (CFR) 173.27. Internationally, the International Civil Aviation Organization (ICAO) provides similar air transport standards in a publication entitled "Technical Instructions for the Safe Transport of Dangerous Goods By Air," at Part 4, 1.1.6. Similarly, the International Air Transport Association (IATA) provides the "IATA Dangerous Goods Regulations" manual that includes packing instructions. Based on current research, and considering particularly the transport of an aliquot of blood, to test for compliance with the standards of all such organizations, an external vacuum test is suitable for testing the pressure resistance of rigid packaging, and the packaging should be able to withstand, without leakage, an internal pressure of 95 kPa.

In an experiment to test the seal of the present transport cap against pressure changes, the transport cap 300 was secured to a transport tube 100 holding 5 ml of water. This combination was then placed in a vacuum chamber and a vacuum was drawn to create a pressure differential between the interior and exterior of the tube and cap combination of 95 kPa. This pressure differential was maintained for 45 minutes, and the cap 300 remained sealed to the transfer tube 100, without leakage.

In light of the foregoing, it should be appreciated that the present invention provides combination tubes and caps that are structurally and functionally improved over the prior art in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. In combination, a tube and cap for retaining an aliquot of fluid suitably for transferring such samples within a laboratory or between laboratories, the combination comprising:

(a) a transfer tube including:

a tube portion having at least one sidewall defining an open top, a flange extending outwardly from and flush with said open top and including a top surface and a bottom surface, at least one channel in said top surface of said flange, and an internal closed bottom extending from said at least one sidewall, (b) a cap including:

at least one peripheral wall, a hub inset from said at least one peripheral wall, a plurality of ribs extending from said hub to said at least one peripheral wall to strengthen said at least one peripheral wall against forces inward toward said hub, a neck having at least one bubble ring, a rim extending from said neck, at least one sealing rib extending from said rim, wherein, when said cap is secured to said transfer tube, said neck extends into said open top of said transfer tube and said at least one bubble ring sealingly contacts said at least one sidewall, at least a portion of said rim lies flush on said top surface of said flange, and said at least one sealing rib extends into said at least one channel.

2. The combination transfer tube and cap of claim 1, wherein said flange is tapered at said top surface and said bottom surface thereof.

3. The combination transfer tube and cap of claim 1, wherein said neck of said cap includes two bubble rings, and both bubble rings sealingly contact said at least one sidewall of said transfer tube when said cap is secured to said transfer tube.

4. The combination transfer tube and cap of claim 1, wherein said at least one sidewall of said transfer tube extends beyond said internal closed bottom.

5. The combination transfer tube and cap of claim 4, wherein the portion of said at least one sidewall that extends beyond said internal closed bottom is reinforced with at least one tube rib.

6. The combination transfer tube and cap of claim 5, wherein said internal closed bottom of said transfer tube is frustoconical or conical to aid in removing fluids therefrom with a pipette.

7. The combination transfer tube and cap of claim 1, wherein at least one neck wall defines said neck, and said hub is also inset from said at least one neck wall, and said plurality of ribs also extend to engage said at least one neck wall to strengthen the same.

8. The combination of claim 1, wherein said sealing rib lies above said bubble ring.

9. In combination, a tube and cap for retaining an aliquot of fluid suitably for transferring such samples within a laboratory or between laboratories, the combination comprising:

(a) a transfer tube including:

a tube portion having at least one sidewall defining an open top, a flange extending outwardly from and flush with said open top and including a top surface and a bottom surface, at least one channel in said top surface of said flange, and an internal closed bottom extending from said at least one sidewall, (b) a cap including:

at least one peripheral wall, a neck having at least one bubble ring, a rim extending from said neck, at least one sealing rib extending from said rim, wherein, when said cap is secured to said transfer tube, said neck extends into said open top of said transfer tube and said at least one bubble ring sealingly contacts said at least one sidewall, and said at least one sealing rib extends into said at least one channel.

* * * * *